US005921214A

United States Patent [19]

Fujita et al.

[11] Patent Number: 5,921,214

[45] Date of Patent: Jul. 13, 1999

[54] INTAKE DEVICE FOR AN INTERNAL COMBUSTION ENGINE

[75] Inventors: Akihiro Fujita; Masahiko Maruyama, both of Hamamatsu, Japan

[73] Assignee: Suzuki Motor Corporation, Shizuoka-Ken, Japan

[21] Appl. No.: 09/060,314

[22] Filed: Apr. 15, 1998

[30] Foreign Application Priority Data

Apr. 17, 1997 [JP] Japan ..... 9-100173

[51] Int. Cl.[6] ..... F02B 77/00

[52] U.S. Cl. ..... 123/198 E; 55/385.3

[58] Field of Search ..... 123/198 E; 180/68.3; 55/385.3

[56] References Cited

U.S. PATENT DOCUMENTS 5,148,786 9/1992 Matsumura et al. ..... 123/198 E 5,564,513 10/1996 Wible et al. ..... 180/68.3

FOREIGN PATENT DOCUMENTS 197119 8/1989 Japan ..... 180/68.3

*Primary Examiner*—Noah P. Kamen

*Attorney, Agent, or Firm*—Nath & Associates; Gary M. Nath

[57] ABSTRACT

An air inlet pipe 4 connected to an air cleaner 2 of an engine room is extended in such a manner as it surrounds a drain hole 8 arranged at the bottom of air cleaner 2. The body of the air inlet pipe 4 is connected to the air cleaner 2. Since the air inlet pipe 4 surrounds the outside space of the drain hole 8 like a barrier, water or snow entering the engine room cannot reach the drain hole 8. Even if the number of engine rotations and negative pressure are increased, the water and snow are not sucked into drain hole 8 and the suction passage is secured.

4 Claims, 5 Drawing Sheets

INTAKE DEVICE FOR AN INTERNAL COMBUSTION ENGINE

BACKGROUND OF THE INVENTION

1. Field of the Invention

An engine (an internal combustion engine) for a vehicle is provided with an air cleaner for intaking a cleaned air.

This invention relates to an intake device for an internal combustion engine, which helps a function of air cleaner provided for intaking cleaned air.

2. Description of the Prior Art

Usually, since an engine provided in an engine room of a vehicle is set in a unit with an air cleaner and covered with a bonnet, the cleaned air is adapted to be supplied avoiding the influence of wind or rain. Further, such air cleaner is provided with a drain hole of 5 mm in diameter and such on the bottom thereof. Thereby, even if moisture inside the air cleaner is condensed, it is drained therethrough to prevent others from coming through the air cleaner.

As one example, as shown in FIG. 7, in a vehicle of the type in which an engine room 1 is disposed at the front side of the vehicle body, an air intake 2*a* of an air cleaner 2 faces to a side panel 3, to which an air inlet pipe 4 is connected, and in communication with a suction pipe 6 in a fender. Further, the suction pipe 6 is provided with a cavity resonator 7. More, at this section alternatively, a suction case which is formed in a unit with the suction pipe 6 and the cavity resonator 7 may be disposed.

Further, the suction pipe 6 and the air cleaner 2 are mounted through a vibration insulator rubber (it is called floating) to prevent a vibration due to an intake pulsation from being transmitted to a vehicle. Here, a sign 8 shows a drain hole (refer to Japanese Utility Model laid-open Nos.

Hei 5-62316 and 5-24948) and a sign 9 shows an outer fender.

In the above structure, the air which is supplied to an engine is sucked in from a suction pipe 6 goes through the air suction inlet 2*a* of the air cleaner 2, a suction opening 2*b*, an inlet pipe 10 and a surge tank (not shown).

And as shown in FIG. 6, there is an idea which a Z-letter like suction pipe (or air inlet pipe) 6 is connected to the air cleaner 2 through the air inlet pipe 4 to reduce a suction noise. The Z-letter suction pipe 6 is mounted on a fender 5 and fixed to it in several portions using a bolt 11, collars 12 and cushion rubbers 13. Further, signs 6*a* and 2*c* are mounting stays.

Normally, when the rotation number of an engine is increased, the shaft rotation connected through a transmission is also increased and as a result, the vehicle speed is increased. Then, since a negative pressure inside the air cleaner as well as an air suction pressure becomes larger, at the time of raining or snowing, water drops entered from outside become apt to be sucked from the drain hole. When the water drops are attached to an element in the air cleaner 2, a passage to the suction pipe 10 becomes substantially narrow and the sucked air is likely to lose a sufficient supply of the air to an engine. Further, since it is not convenient to open a bonnet for regulating various devices at the time of such weather condition, the regulating devices have to be provided inside the vehicle.

On the other hand, since the air inlet pipe 4 is mounted through the cushion rubber in a floating manner and connected to the suction pipe 6, a number of mounting process not only is increased but also becomes complicated, in addition, parts are increased in number. Further, in the case of the suction pipe 6 shown in FIG. 6, where it is mounted on the fender 5 through the cushion rubber 13 and connected to the air cleaner 2, the number of working process is increased and the working becomes complicated.

In the present invention, the purpose of it is to provide an intake device in which a construction of an inlet pipe connected to an air cleaner and a suction pipe are simplified and the outer water drops are prevented from entering through a drain hole.

To attain the above object, the invention described in claim 1, an air inlet pipe connected to an air cleaner in an engine room is extended in such a manner as it surrounds the outside space of a drain hole which is provided at the bottom of air cleaner.

Further, in the invention described in claim 2, in the above construction, the air inlet pipe is connected to the position outside the drain hole of the air cleaner bottom and extended and curved downward.

Further, in the invention described in claim 3, in the structure of claim 1, the air inlet pipe is arranged along a side panel and between the side panel and the air inlet pipe a cushion is interposed.

Further, in the invention described in claim 4, in the construction of claim 1, a body of the air inlet pipe connected to the air cleaner is fixed on the side of the air cleaner in such a manner as it becomes in a unit with the air cleaner, and the air inlet pipe is made apart from the side panel to form it in a floating construction.

In the above construction, since it is for an engine mounted on a vehicle, or engine room is covered with a bonnet and disposed in a front or rear portion of the vehicle. And, since the air cleaner is essential, it does not matter if the engine is arranged horizontally or vertically. Brief explanation of the drawings.

EMBODIMENT

Hereinafter, an embodiment of the present invention is explained based on the attached drawings.

Figure 1:
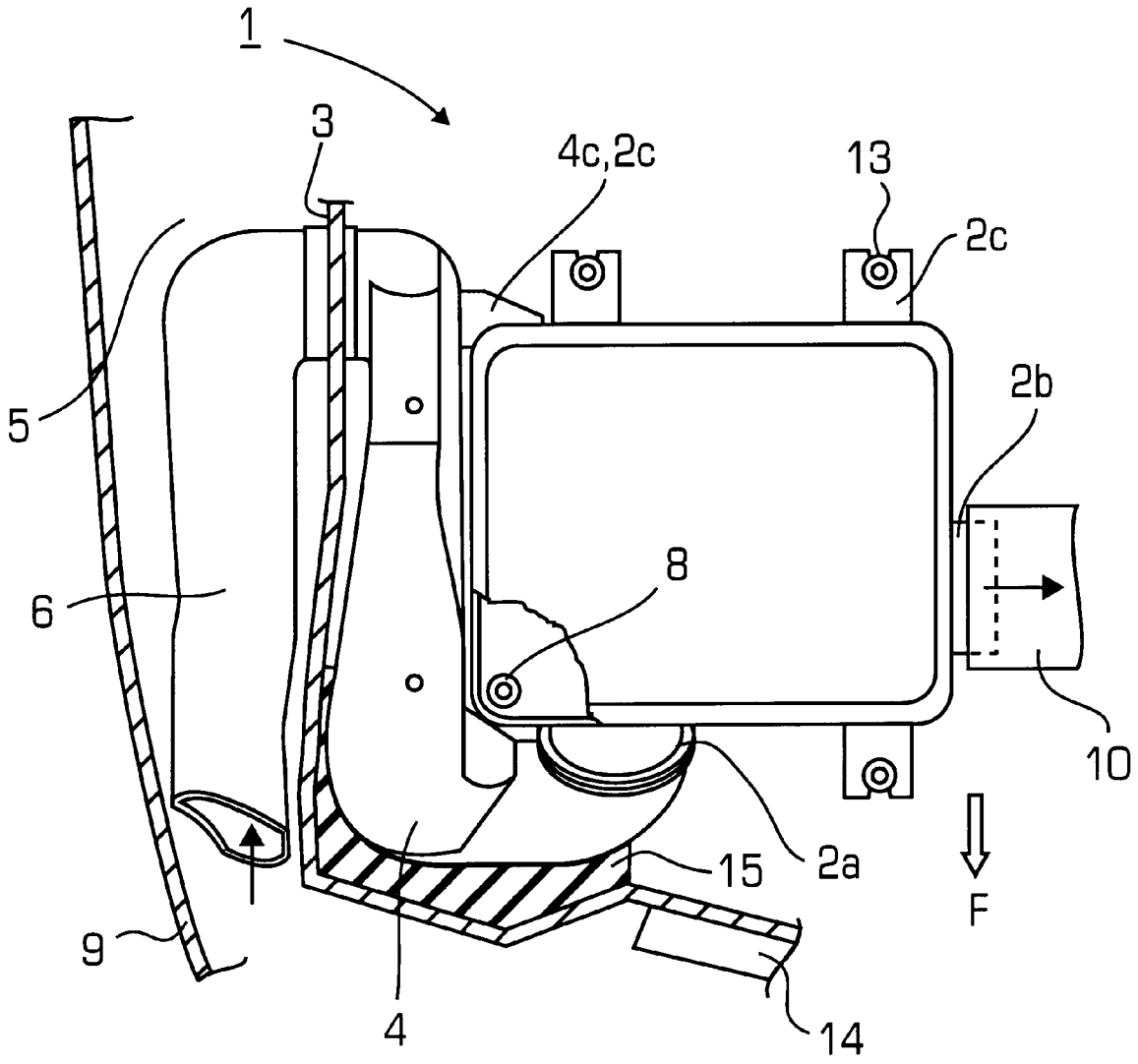
FIG. 1 is a plan view of the intake device of an internal combustion engine.
Figure 2:
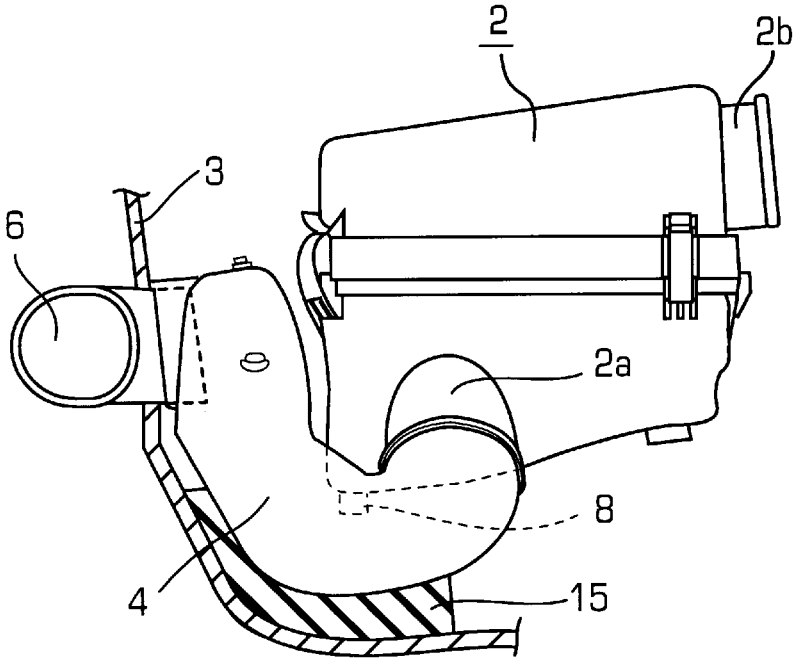
FIG. 2 is a side view of the intake device shown in FIG. 1.

As shown in FIGS. 1 and 2, an air cleaner 2 is fixed in an engine room 1 disposed in a front portion of a vehicle through a cushion rubber 13, a short piece of the J-letter formed air inlet pipe 4 is connected to the front side of the air cleaner 2, a long piece thereof is extended downward between a lamp support bracket (a panel portion of the vehicle) 14 and the air cleaner 2, and is configured along the curved surface of the side panel 3. Then, further bent upward to the origihal height and further extended backward in parallel with the side surface of the air inlet pipe 4 is facing to the side panel 3.

Figure 3:
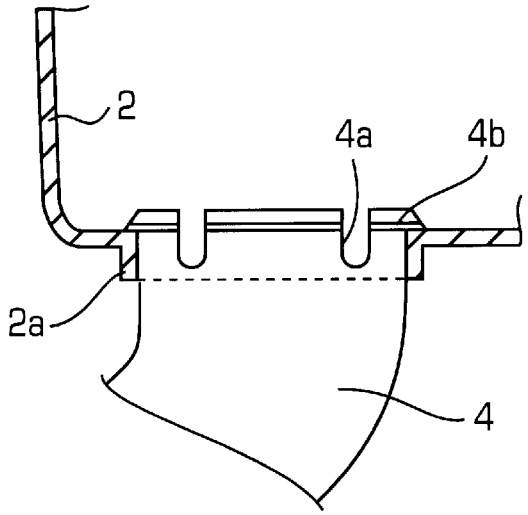
FIG. 3 is a sectional view showing a connection portion of an air inlet pipe of the device shown in FIG. 1.

Further, as shown in FIG. 3, an end portion of the air inlet pipe 4 which is located at the side of the short piece and to be mounted on the air cleaner 2 is formed in a plurality of grooves 4*a* and folded portion 4*b,* which is inserted in the suction inlet 2*a* formed in cylindrical shape to be coupled with it. And, as shown in FIG. 5, an end portion of the long piece side of the air inlet pipe 4 is fixed in a unit with stays 4*c* and 2*c*.

Figure 4:
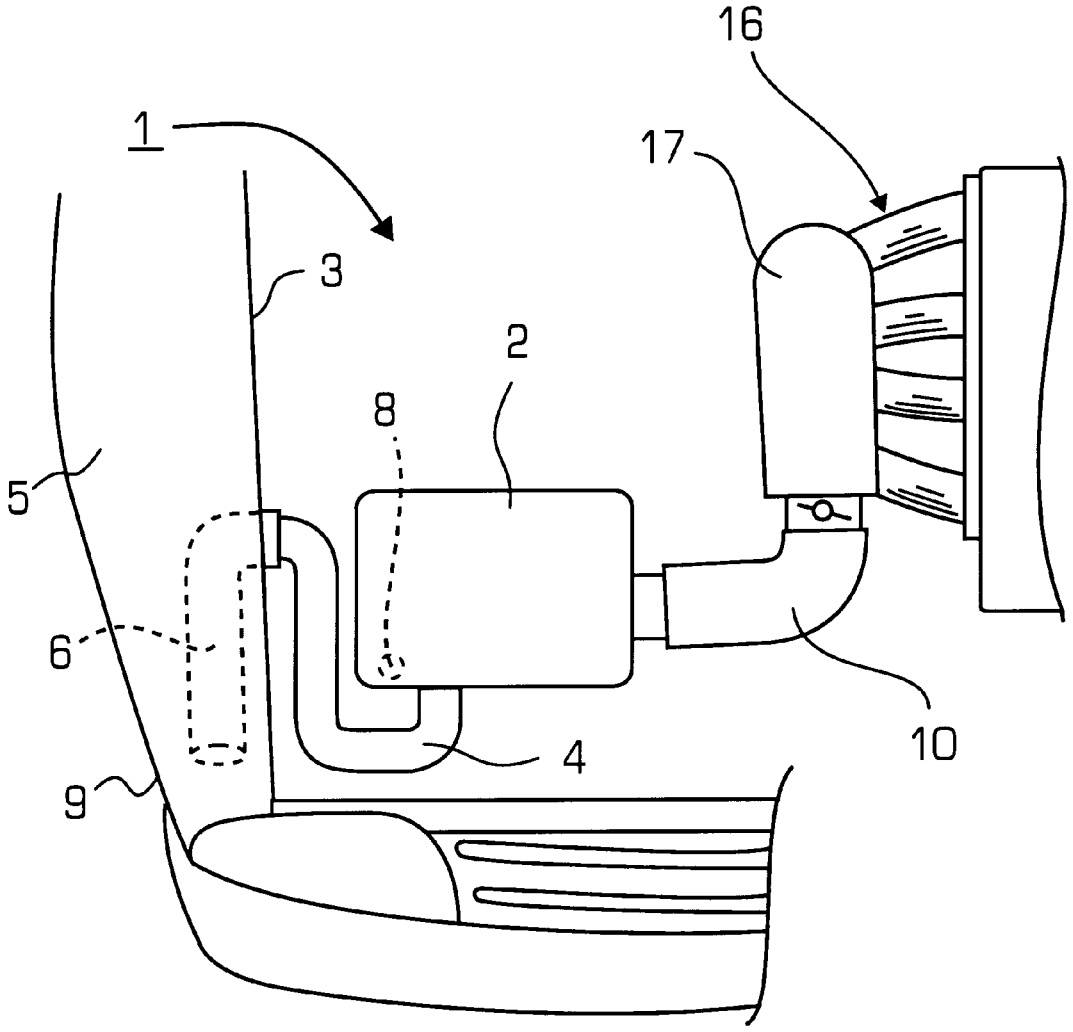
FIG. 4 is a plan view which shows partially an engine room where the device shown in FIG. 1 is disposed.

Thus pipe-arranged air inlet pipe 4 is, as shown in FIGS. 1 and 2, extended in such a manner as it surrounds the drain hole 8, the passage diameter is maintained for securing the output pressure. Further, between the inlet pipe 4 and the side panel a cushion 15 is interposed to separat the inside from the outside. And, as shown in FIGS. 1 and 4, the air inlet pipe 4 is connected to the suction pipe 6 which is located within the fender 5, the suction inlet 2*b* of the air cleaner 2 is connected to the suction tube 10 which is led to the surge tank 17 of an intake manifold block 16.

Due to this construction, if water or snow enters directly into the engine room 1 from the front of the vehicle, the air inlet pipe 4 surrounds the outside of the drain hole 8 like a barrier, so that the water and snow entered in the engine room 1 do not reach the drain hole 8, and accordingly even if the suction pressure becomes larger, an entering of the water or snow from the drain hole 8 is prevented. Accordingly, and outdoor regulation becomes possible. Further, by these arrangement a passage length of the intake system becomes long, so that an air intake noise becomes reduced. In addition, since piping arrangement can be carried out within the lamp support bracket 14, a replacement operation of a lamp can be carried out usually.

Figure 5:
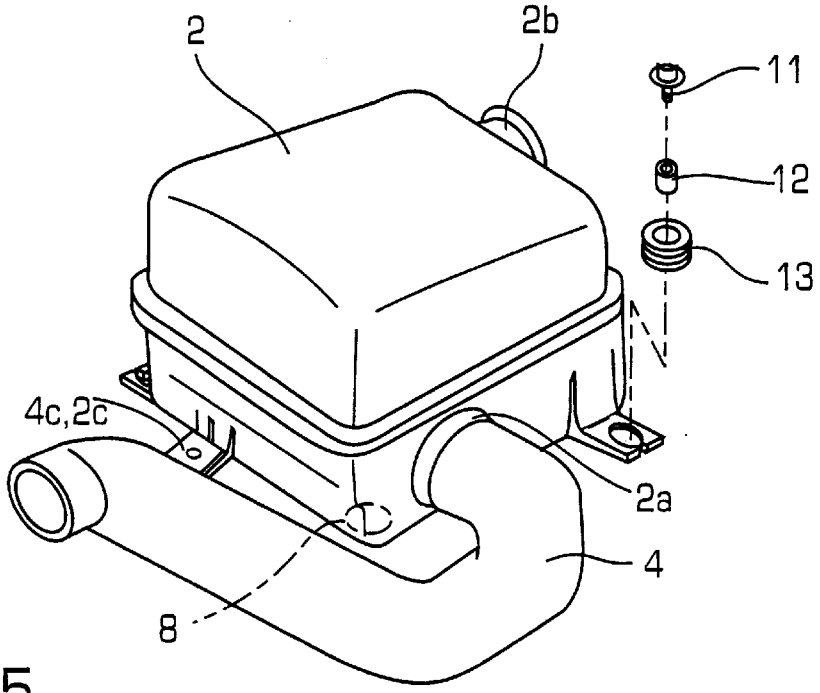
FIG. 5 is a perspective view of the device shown in FIG. 1.
Figure 6:
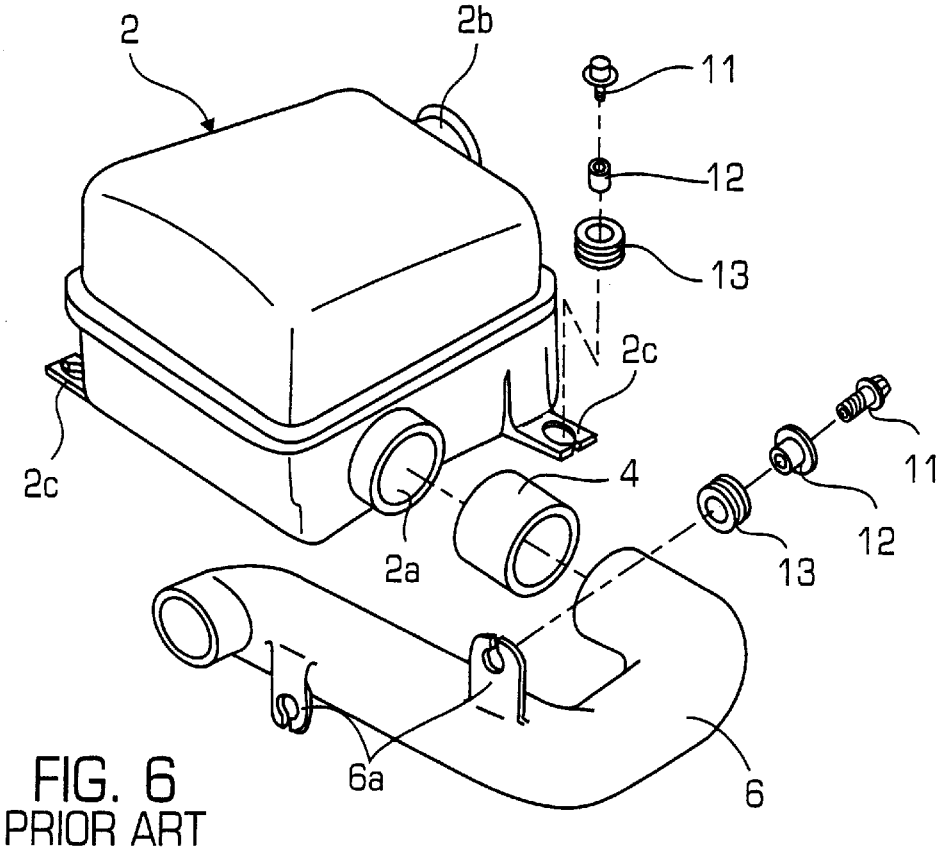
FIG. 6 PRIOR ART
FIG. 6 is a perspective view of an air intake device of a conventional internal combustion engine.
Figure 7:
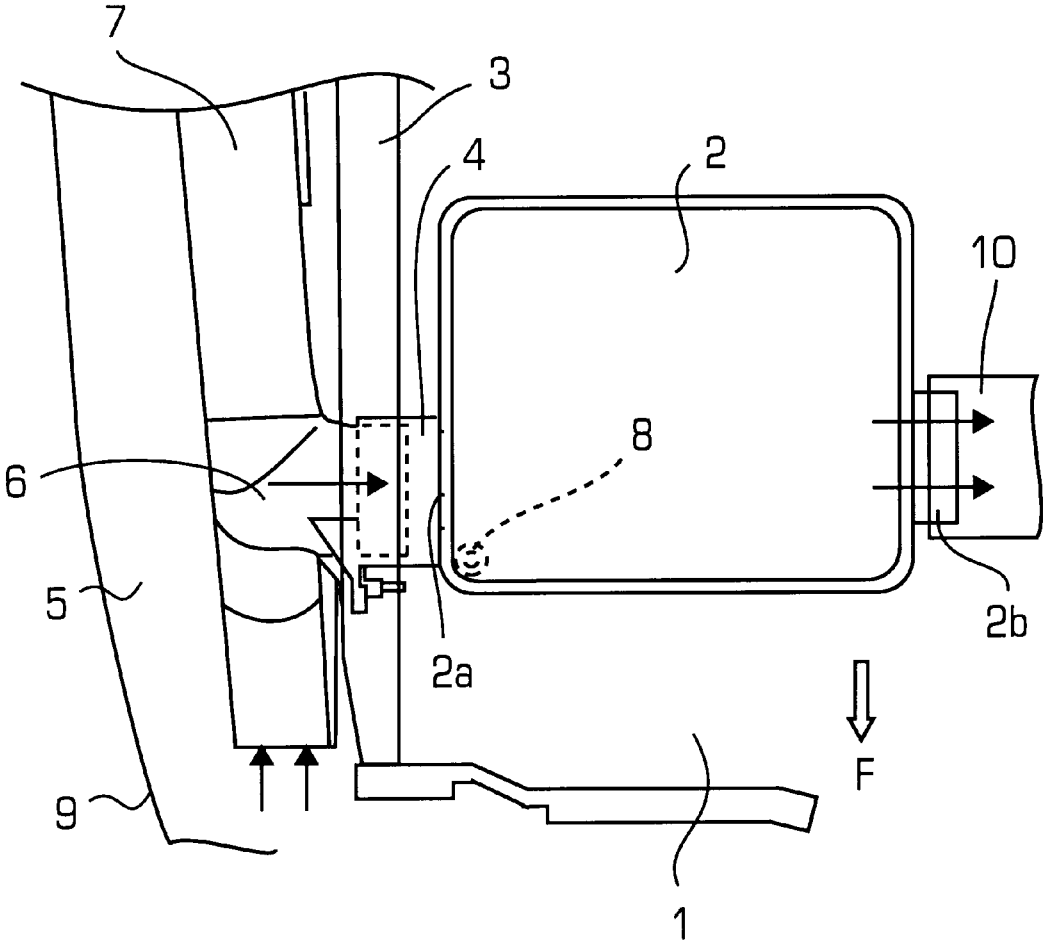
FIG. 7 PRIOR ART
FIG. 7 is a plan view of an air intake device of another conventional internal combustion engine.

Further, as shown in FIG. 5, since the air inlet pipe 4 is arranged along the side of the air cleaner 2, and the piping arrangement is fixed as a whole in a unitary manner, the supporting spots on the vehicle body can be reduced, thereby the vibration transmitting spots to the vehicle body can be reduced in number and also the number of mounting process can be reduced.

According to the present invention thus constructed, since the air inlet pipe surrounds the drain hole disposed on the bottom of the air cleaner, the water and snow entered in the engine room do not reach the drain hole, even with the increased number of engine rotation and the increased negative pressure, the water and snow are not sucked, the suction passage is secured and the engine output can be maintained. Further, since the cushion is filled in the space between the air inlet pipe and the inner fender, which can prevent the water and snow from entering through the space.

In addition, due to the lengthened length of the inlet pipe the suction noise can be reduced.

Further, since the air cleaner and the air inlet pipe are mounted in a unitary manner, the number of the parts to be used and of the mounting process is reduced to increase the ease of mounting.

What is claimed is:

1. An intake device in an internal combustion engine comprising:

an air cleaner located in an engine room, a drain hole provided on a bottom portion of the air cleaner;

an air inlet pipe being connected to said air cleaner and being configured to surround said drain hole so as to prevent any water drops from entering said drain hole.

2. An intake device in an internal combustion engine according to claim 1, wherein the air inlet pipe is connected to the side of the air cleaner, at the outside of the drain hole, and extended and curved downward.

3. An intake device in an internal combustion engine according to claim 1, wherein the air inlet pipe is located along a side panel and a cushion is located between the air inlet pipe and the side panel.

4. An intake device in an internal combustion engine according to claim 1, wherein the air inlet pipe is fixed on a side portion of the air cleaner wherein said inlet pipe is of unitary construction and separated from the side portion of the air cleaner providing a floating construction.

* * * * *